US005392518A

United States Patent [19]

Means

[11] Patent Number: 5,392,518

[45] Date of Patent: Feb. 28, 1995

[54] NAIL CLIPPER

[75] Inventor: Stephen C. Means, Coffeyville, Kans.

[73] Assignees: Stephen M. Elder; Donna R. Dixon, both of Coffeyville, Kans. ; a part interest

[21] Appl. No.: 171,421

[22] Filed: Dec. 21, 1993

[51] Int. Cl.[6] ..... A45D 29/02

[52] U.S. Cl. ..... 30/28; 30/26

[58] Field of Search ..... 30/28, 26; 132/75.5

[56] References Cited

U.S. PATENT DOCUMENTS

| | | | |
|---|---|---|---|
| 504,601 | 9/1883 | Mason | 30/28 |
| 612,990 | 10/1898 | Kiefaber | 30/28 X |
| 970,067 | 9/1910 | Leineweber | 30/29 |
| 3,169,312 | 2/1965 | Fink | 30/28 |
| 3,744,131 | 7/1973 | Manes | 30/28 |
| 4,130,937 | 12/1978 | Kim | 30/28 |
| 4,519,134 | 5/1985 | Bumbera | 30/28 |
| 4,776,090 | 10/1988 | Grassi | 30/28 |
| 4,934,050 | 6/1990 | Athalye | 30/28 |

*Primary Examiner*—Rinaldi I. Rada

*Attorney, Agent, or Firm*—Jacobson, Price, Holman & Stern

[57] ABSTRACT

A pair of generally superposed, elongated horizontal upper and lower jaw members are provided including rear ends tightly joined together and vertically divergent front ends equipped with inwardly projecting and opposing cutting edges is provided. A generally rectangular bail having upper and lower arms disposed above and below the front ends of the upper and lower jaw members is provided and includes upstanding opposite side arms interconnecting corresponding ends of the upper and lower arms. The lower arm is supported from the transverse midportion of the front end of the lower jaw member by mounting structure mounted for angular displacement about an upstanding axis and for angular displacement of the lower arm relative to the mounting structure about an axis substantially coinciding with the longitudinal center axis of the lower arm. An elongated lever is provided including forward and rearward ends and a fulcrum adjacent the forward end thereof and the forward end of the lever is pivotally supported from the upper arm for angular displacement relative thereto about an axis generally coinciding with the center axis of the upper arm. The lever is positionable in a stored position with the fulcrum facing upwardly and also in an operative position with the fulcrum facing downwardly and opposing a portion of the front end of the upper arm spaced rearward of the upper arm of the bail.

8 Claims, 1 Drawing Sheet

NAIL CLIPPER

BACKGROUND OF THE INVENTION

1. Field of the Invention

This invention relates to a nail clipper for clipping fingernails and toenails of human beings, or perhaps small animals. The clipper is constructed in a manner to dispense with the center pivot which is conventionally provided on similar nail clippers and with the clipper thereby having a substantially unobstructed interior in which to receive and retain nail clippings.

The nail clipper includes side walls extending along one of the elongated jaws thereof between which the other jaw is snugly but loosely received and in this manner substantially all nail clippings are retained within the clipper during a nail clipping operation.

2. Description of Related Art

Various different forms of nail clippers heretofore have been provided utilizing some of the general structural and operational features of the instant invention. Examples of these previously known forms of clippers are disclosed in U.S. Pat. Nos. 3,169,312, 3,744,131, 4,519,134, 4,776,090 and 4,934,050.

However, these previously known forms of clippers do not include the overall structural and operational features of the clipper of the instant invention which result in an extremely efficient and readily useable nail clipper operative to retain substantially all nail clippings therein throughout a nail clipping operation.

SUMMARY OF THE INVENTION

A fingernail clipper of the type including a pair of elongated upper and lower spring material jaw members having rear ends secured together and front ends biased slightly apart and defining opposing cutting edges is provided. Lever structure is operatively associated with the front ends of the upper and lower jaw members for releasably forcing the cutting edges into engagement with each other and cutting a fingernail or toenail disposed therebetween.

This type of construction is basically old, but in most previously known structures of this type the lever structure is carried by the upper end of a central pivot fastener rotatably secured upwardly through the forward end of the lower jaw member and rotatably received upwardly through the upper jaw member, the lever structure being pivotally mounted from the upper end of the pivot fastener projecting above the upper jaw member. Further, these previously known central pivot fasteners are disposed closely rearward of the cutting edges of the jaw members and thus constitute obstructions to the entrance of nails to be clipped between the cutting edges from forward of the latter and if one of the jaw members is provided with side walls or flanges between which the other jaw member is received in order to define a receptacle in which to contain nail cuttings, the aforementioned central pivot fastener also further acts as an obstruction to the free falling of nail clippings from the interior of the nail clipper after a nail clipping operation has been carried out.

Accordingly, a need exists, for an improved form of nail clipper which is devoid of the aforementioned central pivot fastener extending between the front ends of the upper and lower jaw member and which therefore is unobstructed to the entrance of a nail to be clipped rearward between the cutting edges of the jaw members and also unobstructed to the free falling of nail clippings from the interior of the clipper after a nail clipping operation has been carried out.

The main object of this invention is to provide an improved nail clipper devoid of the usual actuating lever supporting central pivot fastener extending between the forward ends of the upper and lower lever members thereof within the area disposed between the lever member forward ends.

Another object of this invention is to provide a nail clipper in accordance with the preceding objects and which provides considerably large volume and unobstructed nail clipping retaining space between the lever members thereof without specifically contouring one of the lever members of the clipper in order to provide additional nail clipping storage capacity.

Yet another important object of this invention is to provide a nail clipper in accordance with the preceding objects and including an actuating lever mechanism which may be readily shifted to a position out of operative coacting relationship with the front ends of the jaw members to thereby enable more than usual opening of the jaw members to facilitate the gravity discharge of nail clippings from the interior of the clipper.

Another object of this invention is to provide a nail clipper which may have the actuating lever thereof reconfigured to afford greater or lesser mechanical advantage so as to adapt a larger clipper for cutting toenails and a small clipper for cutting fingernails.

A final object of this invention to be specifically enumerated herein is to provide a nail clipper in accordance with the preceding objects and which will conform to conventional forms of manufacture, be of simple construction and easy to use so as to provide a device that will be economically feasible, long lasting and relative trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
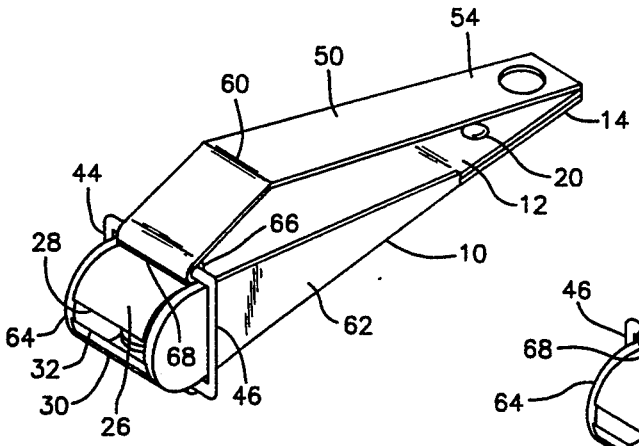
FIG. 1 is a perspective view of the nail clipper with the actuating lever thereof in a non-operative stored position.

Referring now more specifically to the drawings the numeral 10 generally designates the nail clipper of the instant invention. The nail clipper 10 includes upper and lower elongated, horizontally disposed jaw members 12 and 14 with the rear ends 16 and 18 of the jaw members 12 and 14 disposed in contacting superposed relation and secured together through the utilization of suitable fasteners 20 and 22.

The jaw member 12 is constructed of spring material and is forwardly and upwardly inclined as at 24 forward of the fasteners 20 and 22 and includes a forwardly and downwardly rounded forward end 26 terminating downwardly in a cutting edge 28. The forward end of the jaw member 14 includes a forwardly and upwardly rounded forward end 30 which terminates upwardly in a cutting edge 32 opposing and spaced below the cutting edge 28 when the forward end 26 is in its static position illustrated in FIG. 3.

A mounting structure 34 comprising a mounting sleeve is pivotally supported from the transverse central area of the lower jaw member 14 spaced slightly rearward of the front end 30 through the utilization of a low profile pivot fastener 36 fixed relative to the sleeve 34 and rotatably received through an opening provided therefore in the jaw member 14. The sleeve rotatably supports the lower transverse arm 38 of a generally rectangular bail therefrom for angular displacement about an axis coinciding with the center axis of the sleeve 34, the bail 40 including an upper horizontal transverse arm 42 and opposite side arms 44 and 46 extending between and formed integrally with the corresponding ends of the upper and lower arms 42 and 38.

The upper arm 42 is continuous throughout its length and is formed integrally with the opposite side arms 44 and 46 and the lower arm 38 includes a pair of inturned terminal ends carried by the adjacent ends of the arms 44 and 46 with the inturned ends being spaced apart intermediate the opposite ends of the sleeve 34.

The pivot fastener 36 defines a first axis about which mounting structure or sleeve 34 is angularly displaceable, the sleeve 34 defines a second axis about which the lower arm 38 is angularly displaceable, and an elongated cam lever 50 including a forward base end 52 and a rear free end 54 is pivotally supported from the upper 42 as at 56 for angular displacement about a third axis coinciding with the center axis of the upper arm 42.

Figure 2:
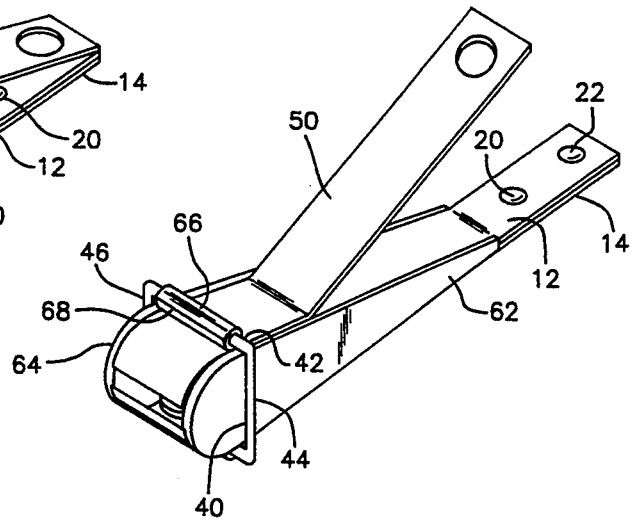
FIG. 2 is a perspective view of the nail clipper with the actuating lever thereof in an operative position.

The lever 50 defines a fulcrum as at 60 at the intersection of the relatively angulated base and free ends 52 and 54 thereof and the fulcrum 60 opposes the upper surface of the free end of the jaw member 12 when the lever 50 is in the act ready operative position thereof illustrated in FIG. 2.

When the lever 50 is in the position thereof illustrated in FIG. 2, the clipper 10 may be grasped in one hand and utilized in the conventional manner to clip a nail inserted rearwardly between the cutting edges 28 and 30. This may continue for an extended length of time inasmuch as the opposite side longitudinal margins of the forward end of the jaw member 14 include upwardly directed opposite sides or flanges 62 and 64 formed integrally therewith and between which the forward end of the jaw member 12 is snugly but loosely received. Thus, the sides or flanges 62 and 64 bridge the gap between the diverging forward ends of the jaw members 12 and 14 in order to define a large volume storage area for clippings as a nail clipping operation continues.

Figure 3:
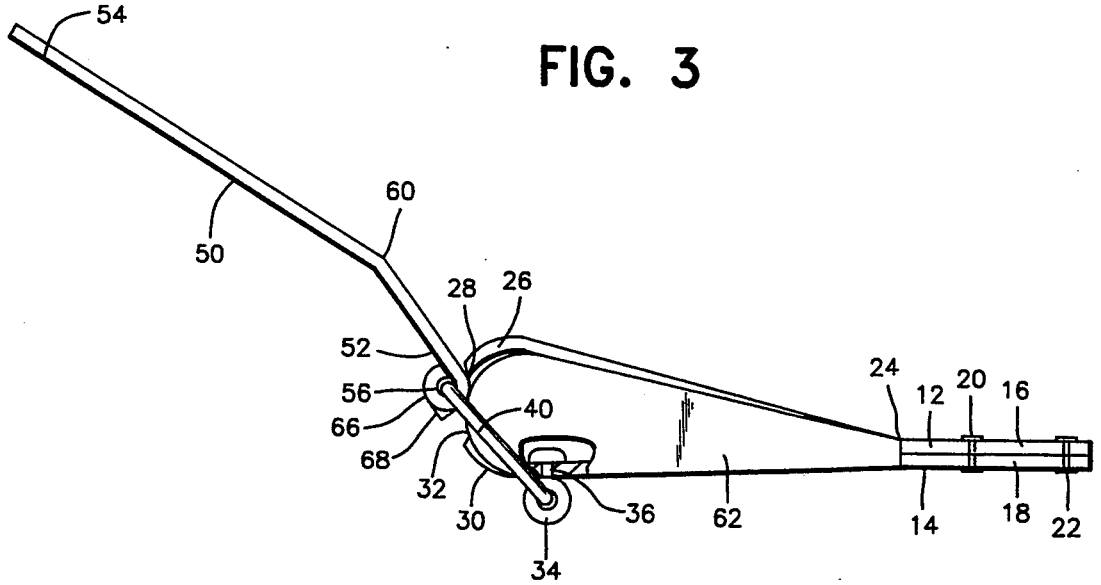
FIG. 3 is an enlarged side elevational view illustrating the position of the actuating lever and the supporting bail therefore swung partially forwardly and downwardly relative to the forward ends of the upper and lower jaw members of the nail clipper preparatory to positioning the nail clipper in a forward and downwardly inclined position for dumping nail cuttings from the interior thereof through increased spacing between the forward cutting edges of the jaw members.
Figure 4:
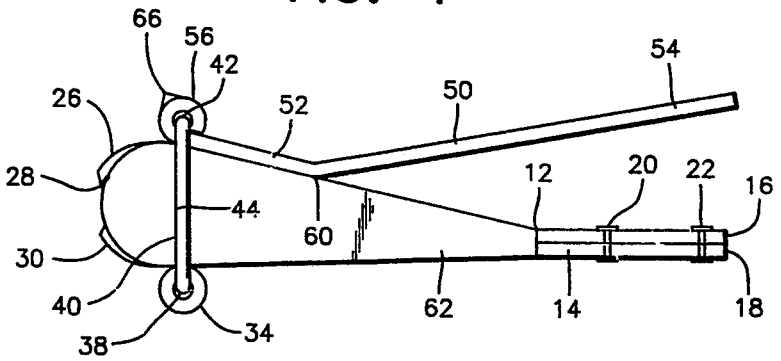
FIG. 4 is an enlarged side elevational view of the assemblage illustrated in FIG. 2.

Once the nail clipping operation has been completed, an upwardly and forward pull is exerted on the lever 50 in order to swing the upper arm 42 of the bail 40 forwardly and downwardly over the front end 26 of the jaw member 12 to the position thereof illustrated in FIG. 3. Thereafter, the lever 50 may be released to allow the bail 40 and the lever 50 to swing by gravity to a downwardly directed position below the front end of the jaw member 14 and the jaw members 12 and 14 may then be tilted toward a substantially vertical position with the forward ends 26 and 30 disposed lowermost in order to freely discharge all nail clippings from between the forward ends 26 and 30 outwardly of the clipper 10 between the cutting edges 28 and 30, the latter being spaced further apart than the spaced apart positions thereof illustrated in FIG. 2.

After the clippings have been discharged from within the interior of the clipper 10, the lever 50 is grasped and turned about its longitudinal axis in order to rotate the bail 40 and the sleeve 34 180° about the first axis 36 and thereafter the free end 54 of the lever 50 is pulled upwardly and rearwardly over the free end 26 of the jaw member 12 as slight downward pressure on the forward end of the jaw member 12 is applied between the thumb and the forefinger of a user holding the clipper 10 in his or her hand. This action places the bail 40 in the position thereof illustrated in FIG. 1 with the lever 50 being disposed substantially upright and its free end 54 uppermost. Then, the free end 54 of the lever 50 may be swung rearwardly and downwardly to the at rest, stored position thereof illustrated in FIG. 1. When in the stored position illustrated in FIG. 1, the rolled portion 66 of the lever 50 at the base end thereof and which receives the arm 42 therethrough presents a rib 68 carried thereby for slight depressive contact with the forward end 26 of the jaw member 12 to thereby maintain the lever 50 in the at rest, stored position thereof illustrated in FIG. 1.

Of course, when it is desired to clip a nail and the clipper has its various components as illustrated in FIG. 1, the free end 54 of the lever 50 may be swung upwardly, forwardly and then downwardly to swing the rolled portion 66 forwardly and downwardly over the front end 26 of the jaw member 12. Thereafter, the lever 50 and bail 40 are allowed to swing vertically downwardly and the lever 50 is then rotated 180° about the first axis 36 and the free end 54 of the lever 50 is again swung upwardly and rearwardly in order to again position the components of the clipper 10 in the manner illustrated in FIG. 2 preparatory to commencing with a nail clipping operation.

The spacing of the fulcrum 60 from the rolled portion 66 may be adjusted according to the size of the clipper 10 and as to whether the clipper 10 is to be used in trimming or cutting fingernails or trimming and cutting toenails. Also, there are various ways in which the bail 40 and mounting structure 34 may be assembled relative to each other. Furthermore, the bail 40 could comprise a pair of opposite side links having corresponding ends removably secured together through the utilization of suitable fasteners serving the function of the arms 42 and 38.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A nail clipper including elongated upper and lower superposed jaw members having front and rear ends, said jaw members being secured together at said rear ends and flexibly biased apart at said front ends, said front ends terminating forwardly in inwardly curving terminal ends defining opposing cutting edges for cutting a nail therebetween when said edges are moved toward each other, a generally rectangularly bail including upper and lower generally horizontal transverse arms and upstanding opposite side arms extending between and interconnecting corresponding ends of said transverse arms with the longitudinal midportion of said lower arm disposed beneath the front end of said lower jaw member, mounting means pivotally mounting said lower arm from said lower jaw member front end for angular displacement about an upstanding first axis disposed generally normal to said lower jaw member centrally intermediate its opposite sides and also for angular displacement of said bail relative to said mounting means about a second axis at least generally concentric with said lower arm, an elongated cam lever including forward and rearward ends and opposite first and second side faces, said cam lever defining a fulcrum thereon adjacent said forward end and spaced therealong toward said rearward end and facing outwardly of said first side face, said forward end being mounted on said upper arm for angular displacement relative thereto about a third axis at least generally concentric with said upper arm, said cam lever, when disposed over said upper jaw member with said fulcrum opposing said upper jaw member, being operable to force the front end of said upper jaw member downwardly toward the front end of said lower jaw member upon downward displacement of said cam lever rearward end toward said upper jaw member rear end, said bail being swingable about said second axis relative to said mounting means to swing said upper arm forwardly over and downwardly past the front ends of said upper and lower jaw members after which said bail may be rotated 180° about said first axis and thereafter about said second axis to swing said upper arm upwardly past the front ends of said jaw members and rearwardly back over said upper jaw member front end with said fulcrum facing upwardly away from said upper jaw member.

2. The clipper of claim i wherein said lower jaw member front end includes upwardly directed opposite sides supported therefrom between which the front end of said upper jaw member is snugly but freely received.

3. The clipper of claim 1 wherein the front end of said upper jaw member is angulated forwardly and upwardly relative to the rear end of said upper jaw member.

4. The clipper of claim 1 wherein said bail opposite side arms and lower arm are integrally formed and said upper arm comprises inturned terminal ends formed on the ends of said side arms remote from said lower arm.

5. The clipper of claim 4 wherein said forward end of said lever includes a rolled portion in which said inturned terminal ends are rotatably received.

6. The clipper of claim 4 wherein said lower jaw member front end includes upwardly directed opposite sides supported therefrom between which the front end of said upper jaw member is snugly but freely received.

7. The clipper of claim 6 wherein the front end of said upper jaw member is angulated forwardly and upwardly relative to the rear end of said upper jaw member.

8. The clipper of claim 5 wherein said rolled portion includes an outstanding rib on the exterior thereof positioned to engage and slightly downwardly depress the front of said upper arm when said lever is disposed generally parallel to said upper arm and said first side face is facing upwardly and away from said first jaw member.

* * * * *